US006991567B2

(12) United States Patent
Wong et al.

(10) Patent No.: US 6,991,567 B2
(45) Date of Patent: Jan. 31, 2006

(54) FOLDABLE STRUCTURE

(75) Inventors: Kenneth Wong, 8370 French Street, Vancouver, BC (CA) V6T 4W2; Dannie Chiu, Kowloon (HK)

(73) Assignee: Kenneth Wong, Vancouver (CA)

( * ) Notice: Subject to any disclaimer, the term of this patent is extended or adjusted under 35 U.S.C. 154(b) by 0 days.

(21) Appl. No.: 10/274,281

(22) Filed: Oct. 18, 2002

(65) Prior Publication Data

US 2003/0203775 A1 Oct. 30, 2003

Related U.S. Application Data

(60) Provisional application No. 60/375,669, filed on Apr. 25, 2002.

(51) Int. Cl.
*A63B 63/00* (2006.01)

(52) U.S. Cl. ..... 473/478; 273/400

(58) Field of Classification Search ..... 473/478, 473/446, 432, 415, 471, 472, 479; 273/400, 273/396, 398, 401; 135/126, 123, 137
See application file for complete search history.

(56) References Cited

U.S. PATENT DOCUMENTS 4,083,561 A * 4/1978 Daffer, Jr. ..... 473/432
4,556,219 A * 12/1985 Tillery ..... 473/197
4,739,784 A 4/1988 Fast
4,825,892 A 5/1989 Norman
5,244,213 A 9/1993 Armell
5,249,592 A 10/1993 Springer et al.
5,427,381 A 6/1995 Macaluso et al.
5,433,433 A 7/1995 Armell
5,582,197 A * 12/1996 Dobberstein ..... 135/87
5,778,915 A * 7/1998 Zheng ..... 135/126
5,842,940 A 12/1998 Macaluso
5,989,130 A 11/1999 Macaluso

* cited by examiner

*Primary Examiner*—Stephen Blau
*Assistant Examiner*—M. Chambers
(74) *Attorney, Agent, or Firm*—Pillsbury Winthrop Shaw Pittman LLP

(57) ABSTRACT

A foldable structure is a singular structure that includes first and second flexible, foldable panels that are pivotally connected to each other along adjacent edge portions. One or more support panels pivotally connects to one of the flexible, foldable panels and removably connects to the other flexible foldable panel. When in an unfolded position, the foldable structure may comprise any of a variety of structures such as, for example, soccer goals, sports goals, basketball hoops, tents, etc. The flexible, foldable panels comprise flexible, foldable, continuous members covered by fabric covers that are sewn together to form the pivotal connections.

34 Claims, 8 Drawing Sheets

FOLDABLE STRUCTURE

CROSS-REFERENCE

This application claims the benefit of priority to U.S. Provisional Patent Application No. 60/375,669, titled "FOLDABLE GOAL," filed on Apr. 25, 2002.

BACKGROUND

1. Field of the Invention

Aspects of the present invention relate, in general, to a portable, multi-purpose foldable structure. Specifically, the embodiments are directed to a singular, foldable structure that can be folded into a hand-held configuration, thereby eliminating time consuming assembly and cumbersome transportation. Embodiments include portable sports goals and tent structures.

2. Description of Related Art

Several different types of portable structures (e.g., sports goals, basketball hoops, tents, billboards, etc.) may be disassembled and reassembled to reduce their size and facilitate their transportation between uses. Unfortunately, disassembleable conventional structures typically have multiple critical pieces that must be totally disconnected from each other to condense such structures to easily transportable sizes. If one or more of the multiple critical pieces are lost, the portable structure cannot serve its function.

Multiple piece structures are also often difficult to assemble. Such difficulty disadvantageously leads to long assembly and disassembly time.

SUMMARY

One or more embodiments of the present invention provide a foldable structure having folded and unfolded positions. A first panel of the structure includes a first foldable, flexible, continuous member and has first and second edge portions. A second panel of the structure includes a second foldable, flexible, continuous member and has third and fourth edge portions. The third edge portion pivotally connects to the first edge portion. A third support panel of the structure has fifth and sixth edge portions. An angle of between 10 and 170 degrees is formed between the fifth and sixth edge portions when the foldable structure is unfolded. The fifth edge portion pivotally connects to one of the second and fourth edge portions, while the sixth edge portion removably connects to the other of the second and fourth edge portions. When the foldable structure is in the unfolded position, the sixth edge portion connects to the other of the second and fourth edge portions and the third support panel holds the second and fourth edge portions at the angle relative to each other. When the foldable structure is in the folded position, the sixth edge portion disconnects from the other of the second and fourth edge portions.

One or more embodiments of the present invention provides a foldable structure having folded and unfolded positions. A first panel of the structure includes a first foldable, flexible, continuous member and a first fabric cover that at least partially covers an internal area of the first flexible, continuous member. A second panel of the structure pivotally connects to the first panel and includes a second foldable, flexible, continuous member and a second fabric cover that at least partially covers an internal area of the second flexible, continuous member. A third support panel of the structure pivotally connects to one of the first and second panels and removably connects to the other of the first and second panels such that, when the foldable structure is in the unfolded position, the third support panel connects to the other of the first and second panels and the third support panel holds the first and second panels at a predetermined angle relative to each other. A length of a perimeter of the third support panel is less than ½ of a length of a perimeter of either of the first or second panels.

Additional aspects of the embodiments of the present invention will become apparent from the following description, the accompanying drawings, and the appended claims.

BRIEF DESCRIPTION OF THE DRAWINGS

For a better understanding of the embodiments of the present invention as well as further features thereof, reference is made to the following description which is to be used in conjunction with the accompanying drawings, where.

DETAILED DESCRIPTION

Embodiments of the present invention resolve many of the shortcomings of conventional foldable structures by providing a one-piece portable structure that eliminates the possibility of losing critical components and by providing a more easily assembled and disassembled portable goal/structure.

Figure 1:
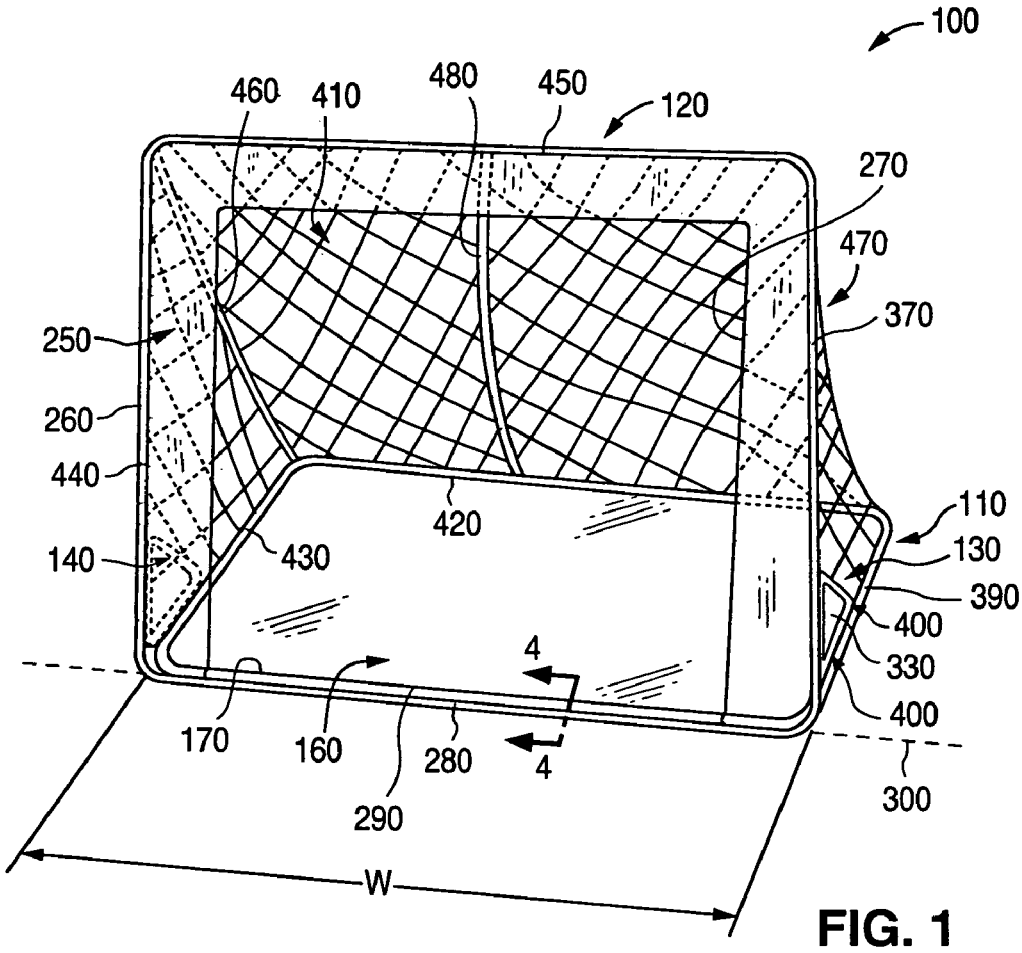
FIG. 1 is a perspective view of a sports goal according to one embodiment of the present invention.
Figure 2:
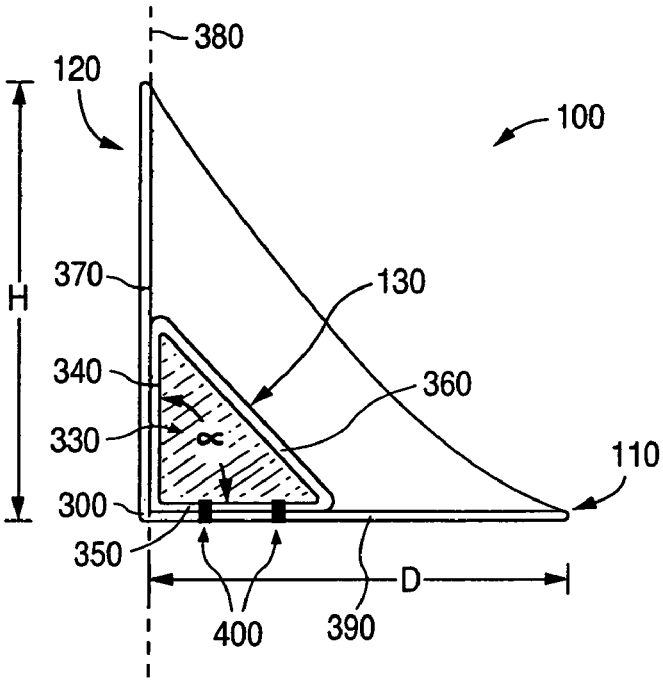
FIG. 2 is a side view of the sports goal illustrated in FIG. 1.
Figure 3:
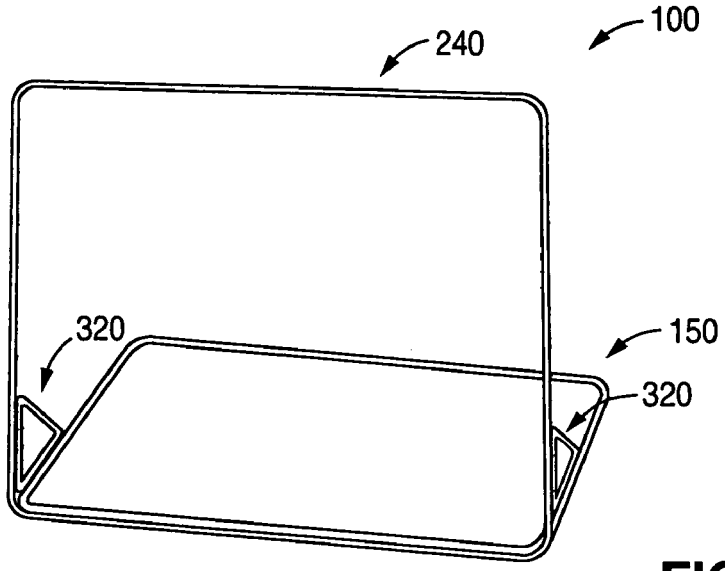
FIG. 3 is a wire-frame perspective view of the goal illustrated in FIG. 1.

FIGS. 1–3 illustrate one embodiment of a foldable structure according to the present invention. In this embodiment, the foldable structure comprises a sports goal 100 that has an unfolded position (see FIGS. 1–4) and a folded position (see FIG. 6).

As illustrated in FIGS. 1 and 2, the goal 100 structurally comprises four interconnected panels: a base panel 110, an upright panel 120, and two support panels 130, 140.

The base panel 110 comprises a foldable, flexible, continuous member 150 (see FIG. 3) that is covered with a flexible, fabric cover 160 (see FIG. 1). As best illustrated in FIG. 4, the flexible fabric cover 160 defines a sewn fabric sheath 170 around its perimeter that holds the continuous member 150.

When the goal 100 is in its unfolded position, the base panel 110 is generally rectangular and is adapted to lay flat on the ground to provide a sturdy base for the goal 100. As illustrated in FIG. 1, the fabric cover 160 covers the entire rectangular area created within the continuous member 150. As would be appreciated by one of ordinary skill in the art, the flexible, continuous member 150 tends to want to form a circle so as to minimize the curvature of the continuous member 150. Accordingly, the fabric cover 160 provides bracing at the curved corners of the base panel 110 that help keep the flexible, continuous member 150 bent in the generally-rectangular shape instead of its natural circular shape.

Figure 5:
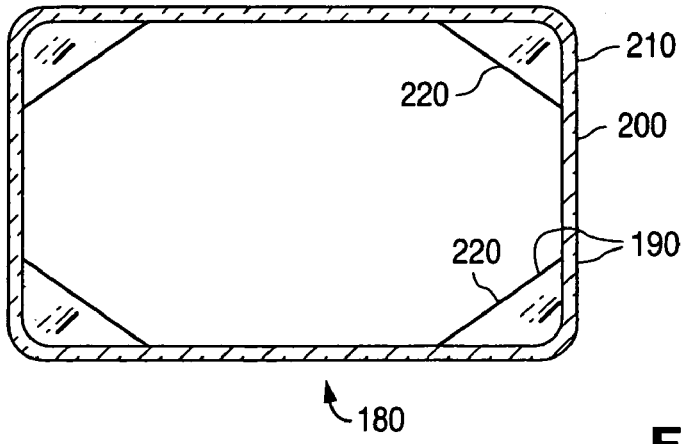
FIG. 5 is a top view of a panel of an additional sports goal according to an additional embodiment of the present invention.

While the illustrated fabric cover 160 covers the entire rectangular area within the continuous member, the fabric cover 160 may be modified to cover less than the entire area without departing from the scope of the present invention. For example, FIG. 5 illustrates an alternative base panel 180, which may be used instead of the base panel 110. The base panel 180 includes a cover 190 that defines a sheath 200 that encloses a flexible, continuous member 210 (shown in dotted lines), but does not cover the entire rectangular area within the member 210. Rather, the cover 190 only includes triangular-shaped fabric braces 220 at the curved corners of the base panel 180. These braces 220 keep the flexible, continuous member 210 (and consequently the base panel 180) bent in the rectangular shape when unfolded.

Figure 4:
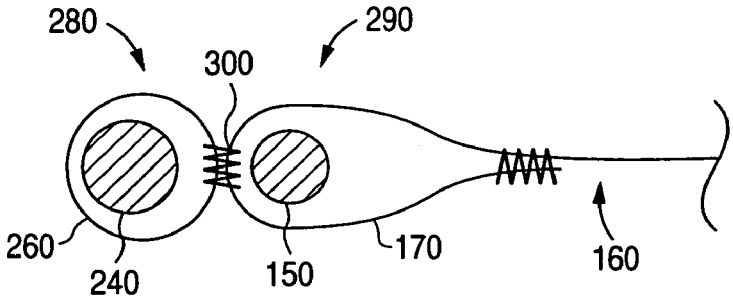
FIG. 4 is a partial, sectional view, taken along the line 4—4 in FIG. 1, of the goal illustrated in FIG. 1.

Like the base panel 110, the upright panel 120 comprises a flexible, continuous member 240 (see FIG. 3) covered by a fabric cover 250 (see FIG. 1) that includes a fabric sheath 260 (see FIG. 4). Also like the base panel 110, the upright panel 120 forms a generally rectangular shape when unfolded. However, as illustrated in FIG. 1, the upright panel 120 differs from the base panel 110 in that the fabric cover 250 only covers part of the internal area of the rectangular shape of the upright panel 120. Specifically, the cover 250 extends inwardly from the top and sides of the upright panel 120 to define an inner rectangular opening 270 that has its base at a lower edge 280 of the upright panel 120. The rectangular opening 270 defines the goal opening into which objects such as soccer balls are projected. Despite having a rectangular opening 270 therein, the cover 250 includes corner brace portions that extend inwardly from the curved comers of the flexible, continuous member 240 and keep the flexible continuous member 240 in the generally rectangular shape when unfolded.

As shown in FIGS. 1 and 2, the lower edge 280 of the upright panel 120 pivotally connects to a forward edge 290 of the base panel 110 such that the lower edge 280 and forward edge 290 are generally parallel and close to each other. As illustrated in the sectional view in FIG. 4, the pivotal connection comprises a sewn joint between the sheath 260 of the cover 250 of the upright panel 120 and the sheath 170 of the cover 160 of the base panel 110. This sewn joint allows the panels 110, 120 to pivot/move relative to each other about a loosely defined axis 300 that is parallel to the lower edge 280 of the upright panel 120 and the forward edge 290 of the base panel 110. While the illustrated joint between the edges 280, 290 is a sewn joint, a variety of other pivoting joints may be used without departing from the scope of the present invention.

The pivotal connection between the edges 280, 290 is not intended to be disconnected during normal use of the goal 100. Accordingly, it is described as a "permanent" connection. The term "permanent" is intended to be defined as permanently connected during normal operation of the goal 100. Accordingly, even a connection that is physically removable/disconnectable is encompassed within the definition of "permanently connected" if such connection is not intended to be disconnected during normal operation and use of the goal 100.

Throughout this description, various components in various embodiments of the present invention will be described as being "pivotally connected." Such pivotal connections are intended to encompass the above-described sewn joint as well as any other permanent pivoting joint that would be understood by one of ordinary skill in the art to provide a similarly functioning joint.

These loose pivotal connections need not absolutely limit relative translational movement between pivotally connected panels. As is apparent in the above-described sewn pivotal joint, a small degree of relative translational movement between pivotally connected panels is possible as well.

The support panels 130, 140 are mirror images of each other. Accordingly, to avoid redundant description, only the support panel 130 is described in detail. The description of the support panel 130 should be understood as describing the mirror-image support panel 140 as well.

The support panel 130 comprises a flexible, continuous member 320 (see FIG. 3) covered by a fabric cover 330 (see FIGS. 1 and 2). As illustrated in FIG. 2, the support panel 130 is generally triangularly shaped and includes forward, lower, and rearward edges 340, 350, 360. In the illustrated embodiment, the support panel 130 defines a right triangle such that an angle $\alpha$ formed between the forward and lower edges 340, 350 is about 90 degrees when the support panel 130 is unfolded. However, the angle $\alpha$ may also be acute or obtuse, is preferably between 10 and 170 degrees, and is more preferably between 80 and 100 degrees.

The forward edge 340 of the support panel 130 pivotally connects to a right edge 370 of the upright panel 120. Accordingly, the support panel 130 pivots relative to the upright panel 120 about a loosely defined axis 380 that is generally parallel to the right edge 370 of the upright panel 120 and the forward edge 340 of the support panel 130.

The lower edge 350 of the support panel 130 removably connects to a right edge 390 of the base panel 110. In the illustrated embodiment, the removable connection comprises a plurality of conventional releasable fasteners such as hook and loop strips 400 that can be selectively wrapped around the edges 350, 390 so as to hold the edges 350, 390 parallel to each other and close to each other. Other fasteners such as buttons, snap buckles, zippers, tie lines, etc. may also be used without departing from the scope of the present invention. This "removable connection" is distinguished from the "pivotal connection" between the base and upright panels 110, 120, because unlike the "pivotal connection" between the base and upright panels 110, 120, the "removable connection" allows for the removably connected components to be separated/disconnected during normal use of the goal 100.

The strips 400 connect the edges 350, 390 so as to hold the goal 100 in its unfolded position. As illustrated in FIG. 2, because edges 340, 350 are separated by the angle α and the edges 340, 350 are parallel to the edges 370, 390, respectively, when the goal 100 is unfolded, the support panel 130 keeps the panels 110, 120 separated by the angle α. Because the illustrated angle α is 90 degrees, when the base panel 110 is laid flat on the ground, the upright panel 120 extends straight upwardly to form the goal 100. If the angle α is obtuse or acute, the upright panel 120 extends upwardly from the base panel 110 in a direction that is not perfectly vertical.

While in the illustrated embodiment, the support panel 130 pivotally connects to the upright panel 120 and removably connects to the base panel 110, the pivotal and removable connections may be flip-flopped without deviating from the present invention. Accordingly, the support panel 130 could pivotally connect to the base panel 110 and removably connect to the upright panel 120.

Netting 410 connects to the base and upright panels 110, 120 between a perimeter defined sequentially by the right edge 370 of the upright panel 120, the right edge 390 of the base panel 110, a rearward edge 420 of the base panel 110, a left edge 430 of the base panel 110, a left edge 440 of the upright panel 120, and an upper edge 450 of the upright panel 120. When the goal 100 is unfolded, the netting 410 provides a back and side to the goal 100 to stop balls or other objects that enter the goal 100 through the opening 270.

A strap 460 extends between an upper left corner of the upright panel 120 and a rearward left corner of the base panel 110. Similarly, a strap 470 extends between an upper right corner of the upright panel 120 and a rearward right corner of the base panel 110. A strap 480 extends between a center of the upper edge 450 of the upright panel 120 and a center of the rearward edge 420 of the base panel 110. The straps 460, 470, 480 provide support to the netting 410 when the goal 100 is unfolded and prevent the upright panel 120 and the base panel 110 from angularly separating by more than the angle α.

Figure 6:
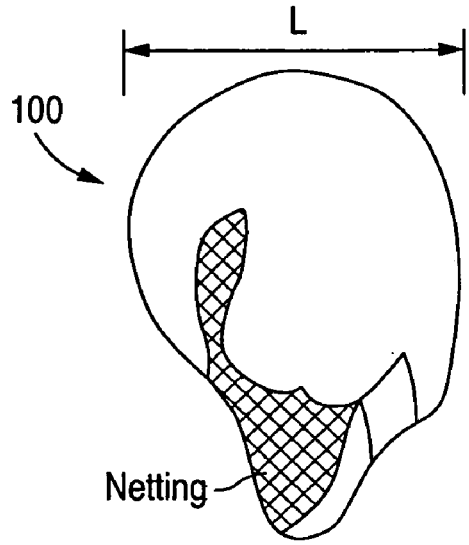
FIG. 6 is a front view of the sports goal illustrated in FIG. 1 in a folded position.

To fold the goal 100, the support panels 130, 140 are first detached from the base panel 110. The base panel 110 and support panels 130, 140 are then folded about the axes 300, 380, respectively, until all four panels 110, 120, 130, 140 are parallel to each other, are generally coplanar, and form a combined rectangular shape. This combined rectangular shape is then twisted and folded in a manner similar to that shown in FIGS. 5B–5E of U.S. Pat. No. 5,778,915 to reduce the rectangular shape into a generally-circular, flat, folded shape that is substantially smaller than the unfolded shape of the goal 100 (see FIG. 6). As illustrated in FIGS. 1 and 6, a longest dimension L of the folded goal 100 is preferably less than ½ of a width W of the unfolded goal 100.

In the illustrated goal 100, the unfolded support panels 130, 140 are substantially smaller than the unfolded base and upright panels 110, 120. A perimeter/circumference of the support panels 130, 140 is preferably less than ½ of the lengths of a perimeter of the base and upright panels 110, 120, and is preferably about ⅓ the length of the perimeter of the base and upright panels 110, 120.

Figure 7:
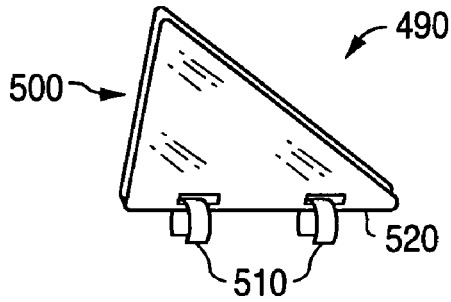
FIG. 7 is a perspective view of a support panel of a further sports goal according to a further embodiment of the present invention.

In fact, the unfolded support panels 130, 140 are preferably even smaller than the folded base and upright panels 110, 120 illustrated in FIG. 6. If so, it is not even necessary to fold the support panels 130, 140 in order to fold the goal 100. Accordingly, as illustrated in FIG. 7, the flexible support panels 130, 140 may be replaced by a rigid support panel 490 that has the same dimensions as the unfolded support panels 130, 140. Such a rigid support panel 490 is preferably constructed from a sheet of generally rigid, light material. The support panel 490 includes a forward edge 500 that may pivotally connect to the right or left edges 370, 440 of the upright panel 120 using cloth or other hinges, etc. Similarly, hook and loop fasteners 510 may be used to removably connect a lower edge 520 of the support panel 490 to the left or right edges 390, 430 of the base panel 110.

In the illustrated embodiment of the goal 100, the base and upright panels 110, 120 have the same rectangular shape and size when unfolded. Accordingly, as illustrated in FIG. 2, a height H of the upright panel 120 equals a depth D of the base panel 110. Similarly, the base and upright panels 110, 120 have identical widths W. To conform to the general shape of traditional rectangular goals, the width W is preferably larger than the height H of the upright panel 130.

When the base panel 110 is unfolded, the edges 390, 420, 430, 290 define the legs of the generally rectangular shape of the base panel 110. Similarly, when the upright panel 120 is unfolded, the edges 280, 370, 450, 440 define the legs of the generally rectangular shape of the upright panel 120.

The shapes and sizes of the various panels 110, 120, 130 of the goal 100 may be altered without departing from the scope of the present invention. Because such alterations affect the unfolded shape of the goal 100 but not the general relationships between the various components, an exhaustive description of each alternative is not provided. Rather, a variety of wire-frame, perspective drawings illustrating various unfolded shapes for the base, upright, and support panels are provided. These embodiments mimic the wire-frame illustration of the goal 100 in FIG. 3.

Figure 8A:
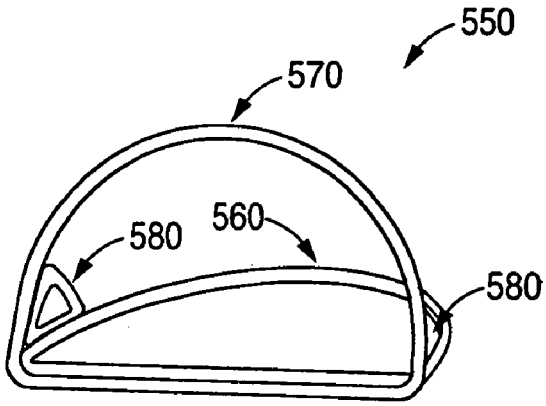
FIGS. 8A–8G are wire-frame perspective views of further sports goals according to further embodiments of the present invention.

FIG. 8A illustrates the unfolded shape of flexible, continuous members of a goal 550 according to an alternative embodiment of the present invention. In this embodiment, a semi-circular, base, flexible, continuous member 560 replaces the member 150 from the goal 100. A semi-circular, upright, flexible, continuous member 570 replaces the upright member 240 from the goal 100. Flexible, continuous members 580 replace the members 320 from the goal 100.

Figure 8B:
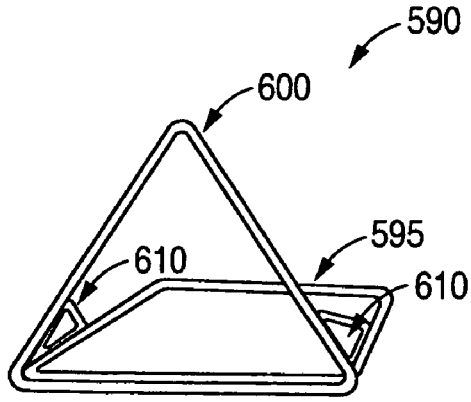

Similarly, FIG. 8B illustrates an additional goal 590 according to an alternative embodiment of the present invention. A base member 595 is rectangular and is similar to the member 150 of the goal 100. An upright member 600 and the support members 610 are triangularly shaped.

Figure 8C:
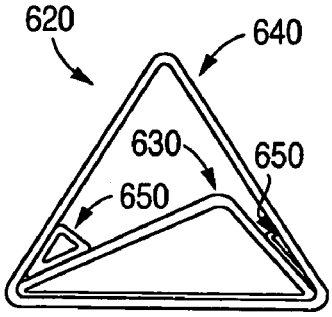

FIG. 8C illustrates an additional goal 620 according to an additional alternative embodiment of the present invention. In this embodiment, the base member 630, upright member 640, and support members 650 are all generally triangularly shaped.

Figure 8D:
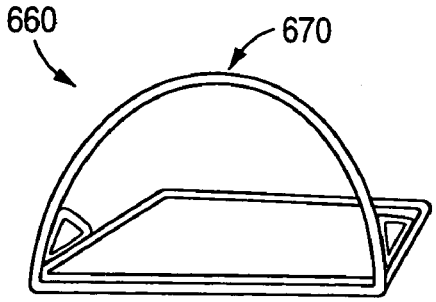

FIG. 8D illustrates an additional goal 660 according to an additional alternative embodiment of the present invention. The goal 660 is similar to the goal 100, except that an upright member 670 is semicircular instead of rectangular.

Figure 8E:
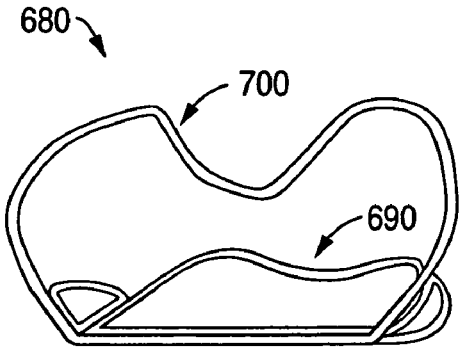

FIG. 8E illustrates an additional goal 680 according to an additional alternative embodiment of the present invention. The goal 680 includes irregularly shaped base and upright members 690, 700.

Figure 8F:
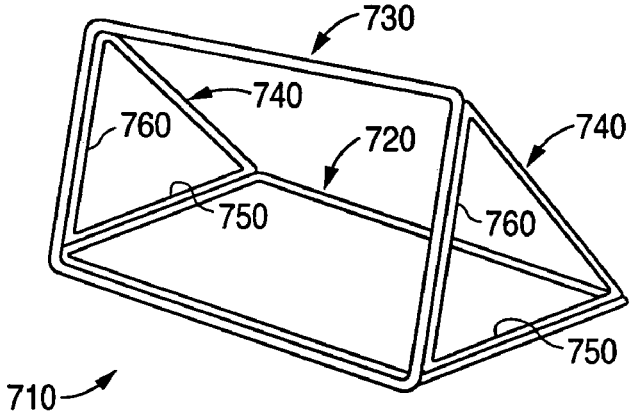

FIG. 8F illustrates an additional goal 710 according to an additional alternative embodiment of the present invention. The goal 710 is similar to the goal 100 because the base and upright members 720, 730 are rectangular. However, the goal 710 differs from the goal 100 because the support members 740 include lower edges 750 that have lengths equal to a depth of the base member 720. Similarly, the support members 740 have forward edges 760 that are equal to a height of the upright member 740.

Figure 8G:
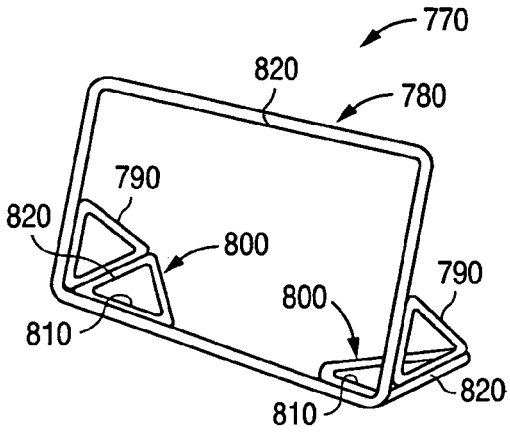

FIG. 8G illustrates an additional goal 770 according to an additional alternative embodiment of the present invention. The upright member 780 and support members 790 of the goal 770 are similar to the members 120, 130 of the goal 100. The base members 800 of the goal 770, however, differ substantially from the base member 110 of the goal 100. The base members 800 are mirror images of each other and are each triangularly shaped. The members 800 are preferably right triangles such that forward edges 810 are perpendicular to side edges 820. As would be appreciated by one of ordinary skill in the art, a netting (not shown) used with the goal 770 is attached to the goal 770 differently than the netting 410 is attached to the goal 100. Such netting may simply hang down from an upper edge 820 of the upright member 780 and include a fair amount of loose material that is capable of stopping a ball that enters the goal 770 through an opening (not shown) formed in a cover (not shown).

As would be appreciated by one of ordinary skill in the art, covers (not shown) for the various members 560, 570, 595, 600, 630, 640, 670, 690, 700, 720, 730, 740 illustrated in FIG. 8 would be designed to brace any tight curves formed in the members 560, 570, 595, 600, 630, 640, 670, 690, 700, 720, 730, 740 so that the covers keep the members 560, 570, 595, 600, 630, 640, 670, 690, 700, 720, 730, 740 in their unfolded shapes.

Covers (not shown) for the upright members 570, 600, 640, 670, 700, 730 illustrated in FIG. 8 may include rectangular openings like the rectangular opening 270 in the cover 250 of the goal 100. Such rectangles would necessarily be dimensioned to fit within the perimeter defined by the upright member 570, 600, 640, 670, 700, 730, while still allowing a sufficient cover area that the cover sufficiently braces the member 570, 600, 640, 670, 700, 730. Alternatively, such covers may have opening shapes that mimic the shapes of their respective upright members 570, 600, 640, 670, 700, 730. For example, a cover for the triangular upright member 600 illustrated in FIG. 8B may include a triangular shaped opening that is somewhat smaller than the triangle defined by the upright member 600.

Figure 9:
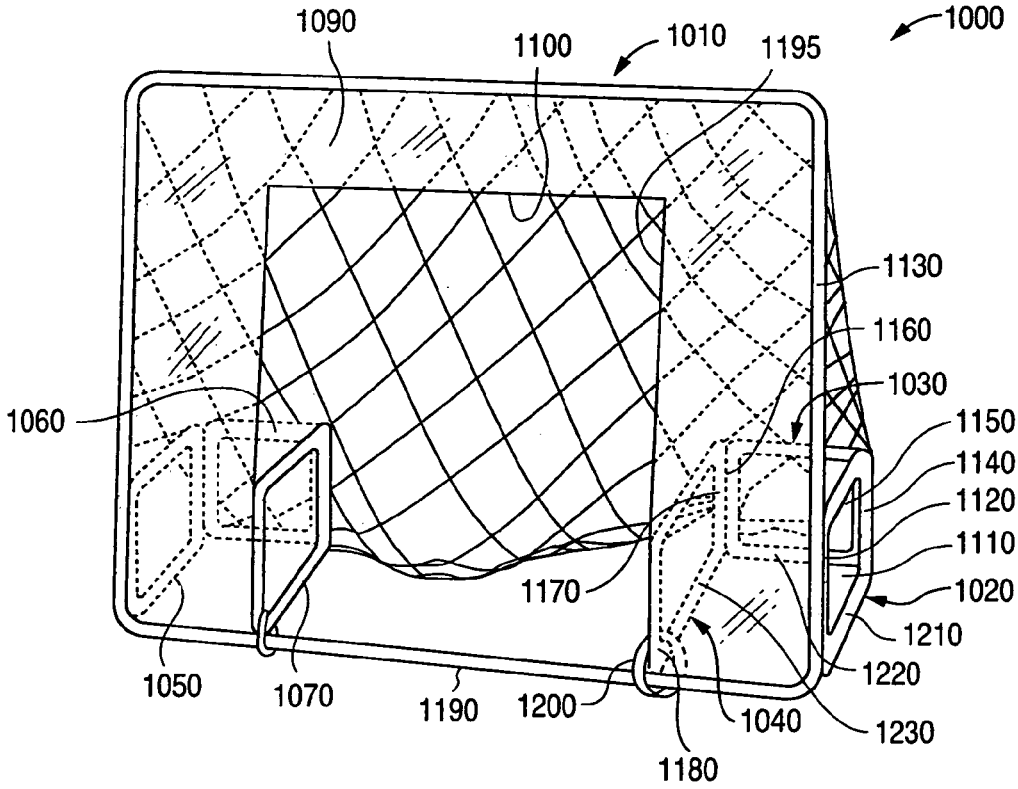
FIG. 9 is a perspective view of a further sports goal according to a further embodiment of the present invention.
Figure 10:
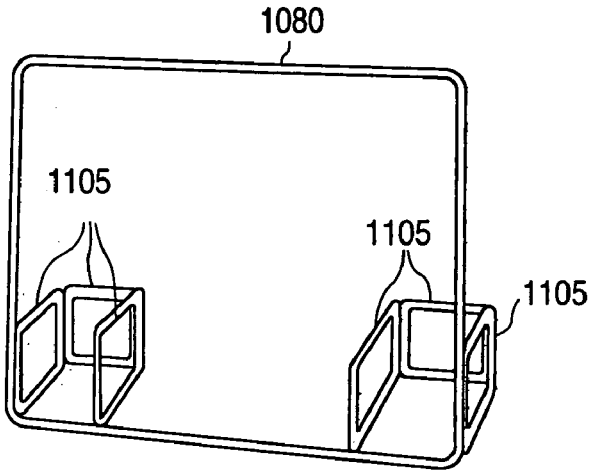
FIG. 10 is a wire-frame perspective view of the sports goal illustrated in FIG. 9.

FIGS. 9 and 10 illustrate an additional foldable goal 1000 according to an additional alternative embodiment of the present invention. The goal 1000 comprises an upright panel 1010 that connects to a plurality of interconnected support panels 1020, 1030, 1040, 1050, 1060, 1070.

The upright panel 1010 is similar to the upright panel 120 of the goal 100 and includes a continuous member 1080 (see FIG. 10) covered by a fabric cover 1090 (see FIG. 9). The fabric cover 1090 defines a rectangular opening 1100 that is similar to the opening 270 in the goal 100.

The support panels 1020, 1030, 1040, 1050, 1060, 1070 are all generally identical to each other. Each support panel 1020, 1030, 1040, 1050, 1060, 1070 includes a flexible continuous member 1105 (see FIG. 10) covered by a cover 1110 (see FIG. 9) (only the cover 1110 for the support panel 1020 is identified). Each cover 1110 preferably covers the entire area within each member 1105 and thereby provides a brace that keeps each member 1105 in a generally square or rectangular shape when unfolded. A length of a perimeter of the continuous member 1105 is preferably less than ½ of a length of a perimeter of the member 1080, and is more preferably about ⅓ of the length of the perimeter of the member 1080.

The support panels 1020, 1030, 1040 are mirror images of the support panels 1050, 1060, 1070. Accordingly, to avoid a redundant description, only the support panels 1020, 1030, 1040 will be described in detail.

As illustrated in FIG. 9, a forward edge 1120 of the support panel 1020 pivotally connect to a right edge 1130 of the upright panel 1010. A rearward edge 1140 of the support panel 1020 pivotally connects to a right edge 1150 of the support panel 1030. A left edge 1160 of the support panel 1030 pivotally connects to a rearward edge 1170 of the support panel 1040.

A lower forward corner 1180 removably connects to a lower edge 1190 of the upright panel 1010. As in the goal 100, the removable connection is preferably provided by a strip of hook and loop fastener 1200 that may be selectively wrapped around the edge 1190 and corner 1180. The removable connection is preferably made at or near a right edge 1195 of the opening 1100 so that the support panels 1030, 1040 do not interfere with an object's path into the goal 1000 through the opening 1100.

As illustrated in FIG. 9, when the corner 1180 is fastened to the lower edge 1190, the support members 1020, 1030, 1040 have lower edges 1210, 1220, 1230, respectively, that are perpendicular to the right edge 1130 of the upright panel 1010. Accordingly, when the lower edges 1210, 1220, 1230, 1190 are placed flat on the ground, the support panels 1020, 1030, 1040 hold the upright panel 1010 vertically. As viewed from above, the support panels 1020, 1030, 1040 and the lower edge 1190 of the upright panel 1010 form a square.

To fold the goal 1000, the support panels 1040, 1070 must first be detached from the lower edge 1190 of the upright panel 1010. All of the support panels 1020, 1030, 1040, 1050, 1060, 1070 can then be folded flat with the upright panel 1010. The flat, rectangular shape of the semi-folded goal 1000 can then be folded in the same manner as the goal 100 to form a compact, generally-circular shape.

The goal 1000 may be altered in a variety of ways without departing from the scope of the present invention. For example, greater or fewer support panels may be used. If two support panels are used on each side of the upright panel 1010 instead of three, the support panel 1030 would be eliminated entirely. In such an embodiment, the rearward edge 1140 of the support panel 1020 would pivotally connect directly to the rearward edge 1170 of the support panel 1040. When the resulting goal is unfolded and viewed from above, the support panels 1020, 1040 and the lower edge 1190 of the upright panel 1010 would form a triangle, instead of a square as in the goal 1000. Alternatively, additional support panels could be added to the chain of sequentially-pivotally-connected support panels 1020, 1030, 1040. For example, if four support panels were used instead of three as in the illustrated embodiment, the four support panels and the lower edge 1190 of the upright panel 1010 would form a pentagon when viewed from above with the structure in its unfolded position. Regardless of the number of support panels used, the first support panel in the chain (e.g., the support panel 1020 in the illustrated embodiment) should be pivotally connected to the forward edge 1120 of the upright panel 1010 and the last support panel in the chain (e.g., the support panel 1040 in the illustrated embodiment) should be removably connected to the lower edge 1190 of the upright panel 1010.

Figure 11:
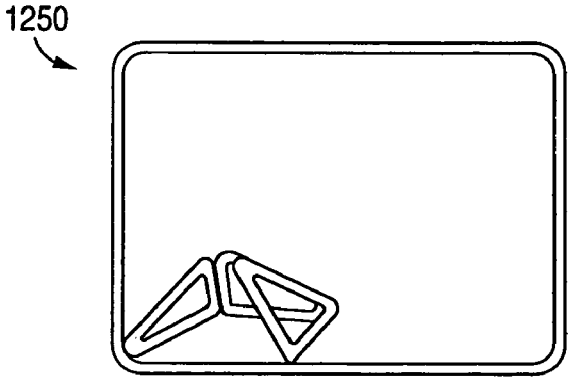
FIG. 11 is a wire-frame perspective view of a further sports goal according to a further embodiment of the present invention.

Furthermore, the support panels 1020, 1030, 1040, 1050, 1060, 1070 may take on a variety of different shapes and sizes without departing from the scope of the present invention. For example, FIG. 11 illustrates the continuous members that form the structure of a goal 1250 that utilizes triangularly shaped support members instead of square support panels as in the goal 1000. Consequently, the support members of the goal 1250 form half-pyramid shaped structures when the goal 1250 is unfolded. The support panels 1020, 1030, 1040, 1050, 1060, 1070 may be fastened to the upright panels 110, 120 in many ways. Example panel fasteners include, but are not limited to, tie strings, custom made plastic clips, zippers, and Velcro® fasteners. (Velcro® is a registered trademark of Velcro Industries B.V.)

Figure 12:
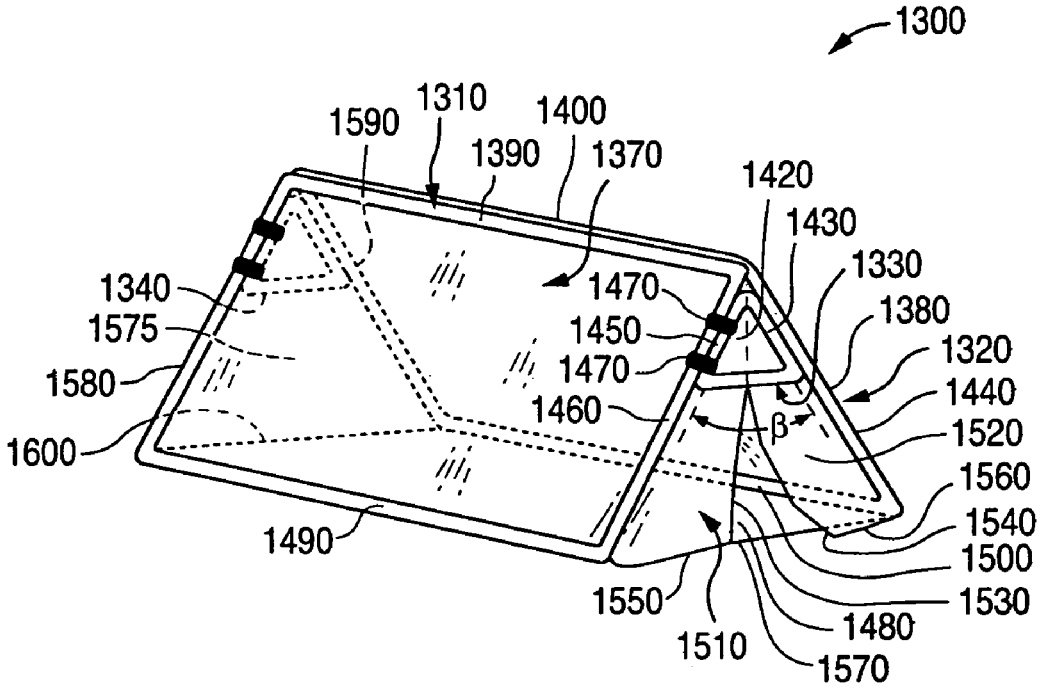
FIG. 12 is a perspective view of a tent according to a further embodiment of the present invention.
Figure 13:
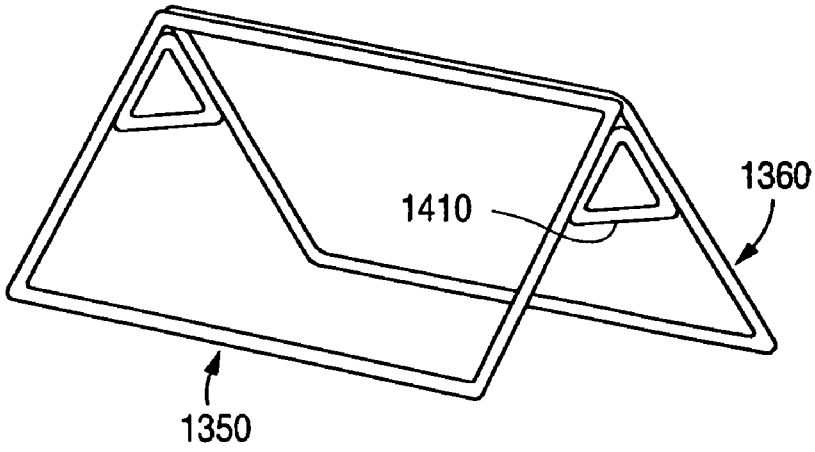
FIG. 13 is a wire-frame perspective view of the tent illustrated in FIG. 12.

FIGS. 12 and 13 illustrate an additional alternative embodiment of the flexible, foldable structure according to the present invention. In this embodiment, the flexible, foldable structure comprises a tent 1300. The tent 1300 is structurally very similar to the goal 100, except that the tent 1300 rotates the structure of the goal 100 by approximately 135 degrees (about the axis 300 of the goal 100).

As illustrated in FIG. 12, the tent 1300 comprises left and right side panels 1310, 1320 that are pivotally connected to each other and pivotally or removably connected to forward and rearward support panels 1330, 1340.

The side panels 1310, 1320 are very similar to the base panel 110 of the goal 100. Like the base panel 100, the side panels 1310, 1320 comprise flexible, continuous members 1350, 1360 (see FIG. 13) that are covered by fabric covers 1370, 1380 (see FIG. 12). When unfolded, the side panels 1310, 1320 are rectangular and the covers 1370, 1380 cover the entire areas within each panel 1310, 1320. The side panels 1310, 1320 are equally sized.

Top edges 1390, 1400 of the side panels 1310, 1320 are pivotally connected, preferably in a manner that makes the resulting connection either water-resistant or waterproof over the length of the top edges 1390, 1400.

The support panels 1330, 1340 are mirror images of each other. Accordingly, only the support panel 1330 is described in detail. The support panel 1330 comprises a flexible, continuous member 1410 (see FIG. 13) that is covered by a fabric cover 1420. The fabric cover 1420 covers the entire area within the continuous member 1410 and braces the continuous member 1410 to keep the continuous member 1410 in a triangular shape when unfolded.

As illustrated in FIG. 12, a right edge 1430 of the triangular support panel 1330 pivotally connects to a forward edge 1440 of the right side panel 1320. A left edge 1450 of the triangular support panel 1330 removably connects to a forward edge 1460 of the left side panel 1310. In this embodiment, the removable connection comprises two hook and loop fasteners 1470 that are permanently attached to the forward edge 1460 of the left side panel 1310. Free ends of the fasteners 1470 may be wrapped around the left edge 1450 of the support panel 1330 to secure the left edge 1450 of the support panel 1330 to the forward edge 1460 of the left side panel 1310.

An angle β formed between the right and left edges 1430, 1450 of the support panel 1330 when the support panel 1330 is unfolded is preferably about 90 degrees, but may also be obtuse or acute. Accordingly, because the right and left edges 1430, 1450 are parallel to the front edges 1440, 1460, respectively of the side panels 1310, 1320, respectively, when the tent 1300 is unfolded, the angle β is formed between the panels 1310, 1320.

A flexible fabric floor 1480 floor extends between lower edges 1490, 1500 of the side panels 1310, 1320, respectively, and is sewn or otherwise attached to the lower edges 1490, 1500. The floor 1480 is dimensioned so that it stretches flat when the tent 1300 is unfolded. The floor 1480 preferably comprises a strong, waterproof fabric that is designed to withstand extended foot-traffic within the tent 1300.

Fabric forward door flaps 1510, 1520 are sewn or otherwise attached to the forward edges 1460, 1440, respectively, of the left and right side panels 1310, 1320. When the door flaps 1510, 1520 hang down, their respective central edges 1530, 1540 align with each other to form a forward door. A zipper, tie line, or other fastener (not shown) may be provided to releasably secure the central edges 1530, 1540 together to keep the forward door closed. A zipper, tie line, or other fastener (not shown) may also be used to releasably secure bottom edges 1550, 1560 of the door flaps 1510, 1520 to a forward edge of the floor 1480.

In this embodiment, the support panel 1330 is positioned in front of the door flaps 1510, 1520 to provide easy access to the support panel 1330 from outside the tent 1300. However, the support panel 1330 could also be positioned behind the door flaps 1510, 1520 inside the tent 1300 to provide a more attractive outer appearance for the tent 1300.

A rearward, flexible, fabric wall 1575 is sewn or otherwise attached between the rearward edges 1580, 1590 of the side panels 1310, 1320 and a rearward edge 1600 of the floor 1480. Alternatively, a rearward door, which is identical to the door flaps 1510, 1520 that create the forward door, may be provided.

The fabric used for the covers 1370, 1380, the door flaps 1510, 1520, and the rearward wall 1575 is preferably waterproof or water-resistant so that the tent 1300 can keep its occupants dry when it rains.

To fold the tent 1300, the support panels 1330, 1340 are first detached from the left side panel 1310. The left and right side panels 1310, 1320 can then be folded together, pivoting relative to each other about an axis that is generally defined by the top edges 1390, 1400. The support panels 1330, 1340 can then be folded flat onto the left side panel 1310 to that the semi-folded tent 1300 is flat and rectangular. The tent 1300 is then folded in the same manner as the previously described goal 100 to reduce the tent 1300 to a generally circular, flat folded tent 1300 (similar is size and shape to the folded goal 100 illustrated in FIG. 6).

Various modifications to the tent 1300 may be made. For example, the door flaps 1510, 1520, rearward wall 1575, and/or floor 1480 may be eliminated. Furthermore, the shapes and sizes of the panels 1310, 1320, 1330, 1340 may be altered. For example, the size of the triangularly shaped support panels 1330, 1340 may be enlarged so that the panels 1330, 1340 extend completely down to the ground and a door to the tent is disposed within one of the panels 1330, 1340. The continuous members used in such a tent would look almost identical to the continuous members illustrated in FIG. 8F, except that the tent rotates the members by approximately 135 degrees. Furthermore, the support panels 1330, 1340 may be replaced with rigid panels like those illustrated in FIG. 7.

Figure 14:
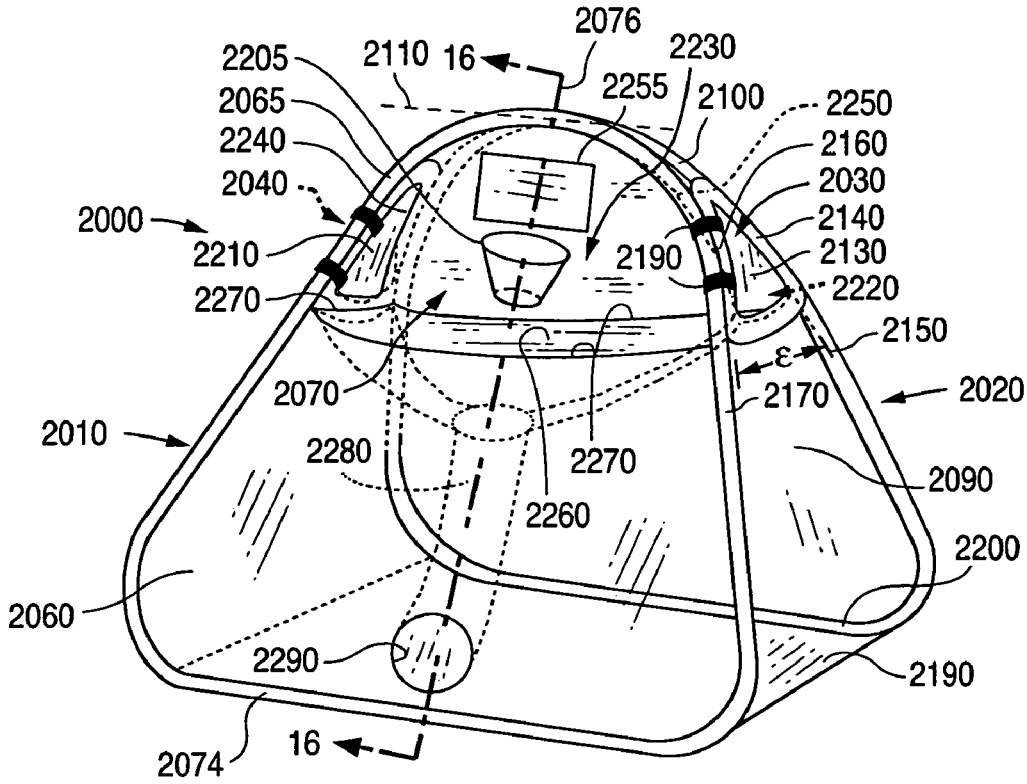
FIG. 14 is a perspective view of a basketball hoop assembly according to a further embodiment of the present invention.
Figure 15:
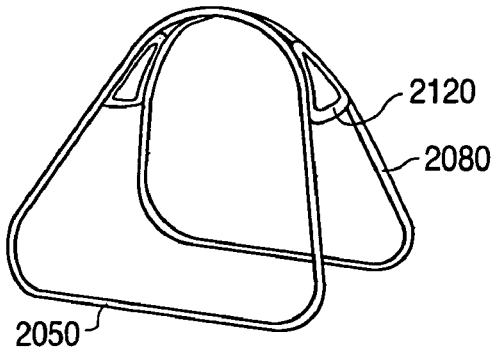
FIG. 15 is a wire-frame perspective view of the basketball hoop assembly illustrated in FIG. 14.
Figure 16:
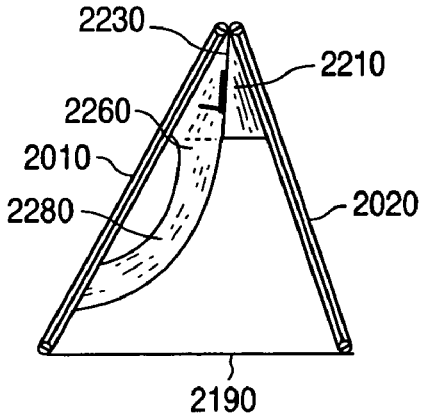
FIG. 16 is a sectional view, taken along the line 16—16 in FIG. 14, of the basketball hoop assembly illustrated in FIG. 14.

FIGS. 14–16 illustrate an additional alternative embodiment of the present invention. In this embodiment, the flexible, foldable structure comprises a basketball hoop assembly 2000.

The basketball hoop assembly 2000 comprises pivotally-connected front and back panels 2010, 2020 and right and left support panels 2030, 2040 that pivotally and removably connect between the front and back panels 2010, 2020. Accordingly, the basketball hoop assembly 2000 is structurally similar to the tent 1300 and goal 100.

The front panel 2010 comprises a flexible continuous member 2050 (see FIG. 15) covered by a fabric cover 2060 (see FIG. 14). As illustrated in FIG. 14, the cover 2060 covers a lower interior area of the continuous member 2050. In an upper area of the panel 2010, the cover 2060 merely forms a sheath 2065 that surrounds an upper portion of the continuous member 2050. Consequently, a generally half-circle-shaped opening 2070 is formed in an upper portion of the front panel 2010.

The cover 2050 forms a brace for the continuous member 2050 that keeps the perimeter of the front panel 2010 in a somewhat trapezoidal shape. A lower edge 2074 of the front panel 2010 is generally linear. Conversely, an upper edge 2076 of the front panel 2010 is curved.

The back panel 2020 comprises a flexible, continuous member 2080 (see FIG. 15) that is covered by a cover 2090 (see FIG. 14). As illustrated in FIG. 14, the cover 2090 covers an entire interior area of the panel 2020 and braces the continuous member 2080 so that the panel 2020 forms a shape that is substantially identical to the unfolded shape of the front panel 2010.

An upper curved edge 2100 of the back panel 2020 pivotally connects to the upper curved edge 2076 of the front panel 2010. While the curvature of the upper edges 2076, 2100 prevents the front and back panels 2010, 2020 from perfectly pivoting relative to each other, sufficient leeway is provided that the front and back panels 2010, 2020 can pivot relative to each other to some extent about a loosely defined horizontal axis 2110.

The support panels 2030, 2040 are similar to the support panels in the previous embodiments. Because the support panels 2030, 2040 are mirror images of each other, only the support panel 2030 is described in detail. The support panel 2030 comprises a continuous, flexible member 2120 (see FIG. 15) covered by a cover 2130 (see FIG. 14) that makes each support panel 2030, 2040 generally triangular when unfolded. A rear edge 2140 of the support panel 2030 pivotally connects to a right edge 2150 of the back panel 2020. It should be noted that because the upper edge 2100 and right edge 2150 of the back panel 2020 both form parts of the same general curve of the panel 2020, a precise dividing line between the two edges 2100, 2150 does not exist.

A front edge 2160 of the support panel 2030 removably connects to a right edge 2170 of the front panel 2010.

A flexible, fabric floor 2190 extends between and is sewn or otherwise attached to the lower edge 2074 of the front panel 2010 and a corresponding lower edge 2200 of the back panel 2020. The floor 2190 prevents the front and back panels 2010, 2020 from separating from each other too much.

As illustrated in FIG. 14, an angle $\epsilon$ is formed between the front and back edges 2160, 2140 of the support panel 2030 when the support panel 2030 is unfolded. The angle $\epsilon$ is preferably acute and is more preferably between about 10 and 70 degrees. Accordingly, when the basketball hoop assembly 2000 is unfolded, the support panel 2030 keeps the front and back panels 2010, 2020 separated from each other by the angle $\epsilon$.

Hereinafter, a basketball hoop 2205 and surrounding structure of the basket ball hoop assembly 2000 will be described.

A left, flexible, fabric side 2210 extends between upper portions of the front and back panels 2010, 2020 in the same area as the left support panel 2040. A similar right, flexible, fabric side 2220 (shown in dotted lines in FIG. 14) is also provided.

A backboard fabric 2230 hangs down from the top edges 2076, 2100 of the front and back panels 2010, 2020. Side edges 2240, 2250 of the backboard fabric 2230 are sewn or otherwise attached to either the flexible fabric sides 2210, 2220 or the side edges of the either the front or back panels 2010, 2020. Accordingly, the backboard fabric is held in a generally vertical, planar position when the basketball hoop assembly 2000 is unfolded.

The miniature basketball hoop 2205 is mounted to a middle portion of the backboard fabric 2230. A rigid backboard 2255 is also mounted to the backboard fabric 2230 above the hoop 2205.

A fabric funnel 2260 is formed below the hoop 2205. An upper edge 2270 of the funnel 2260 is sewn or otherwise connected to a lower edge of the backboard fabric 2230, the lower edges of the fabric sides 2210, 2220, and an edge of the cover 2060 that defines a lower edge of the opening 2070. Consequently, any object (i.e., miniature basketball) that enters the opening 2070 will naturally fall down into the funnel 2260 after being stopped by the backboard fabric 2230 and/or the fabric sides 2210, 2220.

A fabric tube 2280 operatively connects a lower end of the funnel 2260 to a ball-return hole 2290 formed in a lower portion of the cover 2060 of the front panel 2010. The ball-return hole 2290 is positioned lower than the opening 2070. The fabric tube 2280, funnel 2260, backboard fabric 2230, and fabric sides 2210, 2220 jointly define an object passageway that operatively connects the opening 2070 to the ball-return hole 2290. Various components of this object passageway may be combined or eliminated without departing from the scope of the invention. For example, even if the fabric sides 2210, 2220 were eliminated, the resulting gap would not interfere significantly with the functionality of the object passageway. When the basketball hoop assembly 2000 is unfolded and a ball or other object is thrown into the opening 2070 in the front panel 2010, the ball drops down into the funnel 2260, falls through the fabric tube 2280, and is propelled out of the ball-return hole 2290 back toward a person who threw the ball.

The ball-return hole 2290, as well as various other portions of the fabric used in the basketball hoop assembly 2000, may be reinforced with additional pieces of fabric or other reinforcing means.

The basketball hoop assembly 2000 may be folded and unfolded in the same manner as the previously described foldable structures.

The support panels 2030, 2040 may be eliminated without departing from the scope of the present invention. If the support panels 2030, 2040 are eliminated, the floor 2190 and/or fabric sides 2210, 2220 would be used to keep the front and back panels 2010, 2020 from being spaced too far apart. Similarly, the non-vertical orientation of the front and back panels 2010, 2020 of the unfolded basketball hoop assembly 2000 would tend to prevent the panels 2010, 2020 from collapsing toward each other when the basketball hoop assembly 2000 is unfolded and used.

Figure 17:
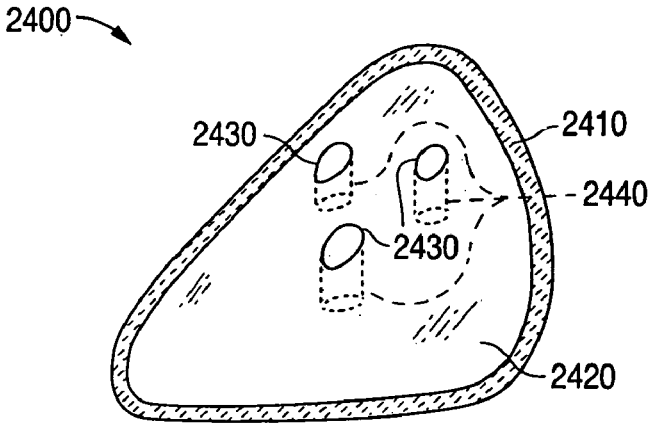
FIG. 17 is a perspective view of a panel according to a further embodiment of the present invention.

FIG. 17 illustrates an alternative panel 2400 that may replace either the front or back panel 2010, 2020 of the basketball hoop assembly 2000. The panel 2400 comprises a flexible continuous member 2410 (shown in dotted lines) covered by a fabric cover 2420 that covers substantially an entire internal area within the continuous member 2410. A plurality of holes 2430 are formed in the fabric cover 2420. Fabric pockets 2440 are attached to the covers 2420 at the holes 2430. In use, a person throws balls, bean bags, etc. at the holes 2430 in an attempt to get the balls into the pockets 2440.

Pivotally connected edges of connected panels according to the present invention are preferably substantially linear when the foldable structure is unfolded. The linearity of the edges ensures that the connections between such connected edges function as loosely defined pivot axes. However, as illustrated in the basketball hoop assembly 2000 embodiment, such linearity is not required. In the basketball hoop assembly 2000, the pivotally connected upper edges 2076, 2100 of the front and back panels 2010, 2020 are curved, even when the basketball hoop assembly 2000 is in its fully unfolded position.

Furthermore, while not required by the present invention, it is preferable that the covers of panels, which have edges that rest against the ground during use, provide braces that keep the ground-touching edges of the ground-touching continuous members in a generally linear shape. For example, as illustrated in FIG. 14, the covers 2060, 2090 of the front and back panels 2010, 2020 of the basketball hoop assembly 2000 keep the ground-touching lower edges 2074, 2200 of the panels 2010, 2020 (and flexible continuous members 2050, 2080) in a generally linear orientation that helps the unfolded basketball hoop assembly 2000 stand up properly on flat ground.

Throughout the description and claims of the foldable structure, various panels and continuous members are described as having specific angled shapes (e.g., square, rectangle, triangle, half-circle, etc.). Because flexible, continuous members cannot typically form tight angles, a "triangular" shape, for example, encompasses a generally triangular shape with curved angles. Alternatively, the flexible, continuous members of the present invention may be designed to have pre-formed angles that more readily form the tight angles of such angular shapes.

Throughout the description and claims of the foldable structure, various components are described as being fabric. As used herein, unless otherwise expressly stated, "fabric" is to be given its broadest meaning and is not limited to woven cloth. Rather, the term "fabric" is merely used to describe a flexible sheet of material. Accordingly, "fabric" includes materials such as flexible plastic sheets, canvas, cloth, etc. The fabric used in the foldable structures is preferably strong, light, and flexible. If the foldable structure is to be used outdoors, the fabric should be water-resistant and durable enough to withstand the wear and tear associated with rugged outdoor use. The fabric should also be strong enough to withstand rough treatment by children. Examples of such fabrics include, but are not limited to, synthetic fibers such as nylon or polyester fibers, cotton, terry cloth cotton, or Spandex fibers such as DuPont Lycra® fibers.

The flexible, continuous members according to the present invention may each be provided as one continuous loop, or may be a strip of material connected at both ends to form a continuous loop. The flexible continuous members may comprise any of a variety of flexible, elongated materials. For example, the flexible, continuous members may comprise spring-steel wire, coiled steel, plastic, fiberglass, graphite, etc. The flexible, continuous members should be strong and light. Furthermore, the flexible, continuous members should be flexible enough that they can be bent into the various folded and unfolded shapes described above.

In the illustrated embodiments of the present invention, the flexible, continuous members are loosely held within sheaths of their respective covers (see e.g., FIG. 4). However, the flexible, continuous members may be attached to their respective covers in a variety of other ways without departing from the scope of the present invention. For example, the flexible, continuous members may be glued, stitched, or otherwise mechanically fastened directly to outside edges of their respective covers.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed is:

1. A foldable structure having folded and unfolded positions, the foldable structure comprising:

a first panel comprising a first foldable, flexible, continuous member and having first and second edge portions;

a second panel comprising a second foldable, flexible, continuous member and having third and fourth edge portions, the third edge portion being pivotally connected to the first edge portion; and a third support panel having fifth and sixth edge portions, an angle of between 10 and 170 degrees being formed between the fifth and sixth edge portions when the foldable structure is unfolded, the fifth edge portion being pivotally connected to one of the second and fourth edge portions, the sixth edge portion being removably connected to the respective one of the second and fourth edge portions such that (a) when the foldable structure is in the unfolded position, the sixth edge portion is connected to the respective one of the second and fourth edge portions and the third support panel holds the second and fourth edge portions at the angle relative to each other, and (b) when the foldable structure is in the folded position, the sixth edge portion is disconnected from the respective one of the second and fourth edge portions.

2. The foldable structure of claim 1, wherein the foldable structure may be folded into the folded position by disconnecting the sixth edge from the respective one of the second and fourth edges, folding all three panels flat, and then folding the panels together.

3. The foldable structure of claim 1, wherein the first panel further comprises a first fabric cover that at least partially covers an internal area of the first flexible, continuous member, and wherein the second panel further comprises a second fabric cover that at least partially covers an internal area of the second flexible, continuous member.

4. The foldable structure of claim 3, wherein the first cover defines a brace that tends to hold the first member in a predetermined shape when the foldable structure is unfolded, and wherein the second cover defines a brace that tends to hold the second member in a predetermined shape when the foldable structure is unfolded.

5. The foldable structure of claim 3, wherein the pivotal connection between the first and third edge portions comprises an attachment between the first and second covers.

6. The foldable structure of claim 1, wherein the first, second, and third panels are permanently connected together such that the members form a single foldable structure.

7. The foldable structure of claim 1, wherein the first through sixth edge portions are each substantially linear when the foldable structure is in the unfolded position.

8. The foldable structure of claim 7, wherein the first and third edge portions are parallel to each other when the foldable structure is in its unfolded position.

9. The foldable structure of claim 8, wherein the fifth edge portion and the one of the second and fourth edge portions are parallel to each other when the foldable structure is in its unfolded position.

10. The foldable structure of claim 9, wherein, when the foldable structure is in its unfolded position, the first panel forms a first rectangle with the first and second edge portions defining adjacent legs of the first rectangle, and wherein, when the foldable structure is in its unfolded position, the second panel forms a second rectangle with the third and fourth edge portions defining adjacent legs of the second rectangle.

11. The foldable structure of claim 10, wherein the first panel has a seventh edge portion that defines a leg of the first rectangle opposite to the second edge portion, and wherein the second panel has an eighth edge portion that defines a leg of the second rectangle opposite to the fourth edge portion, and wherein the foldable structure further comprises a fourth support panel having ninth and tenth edge portions, the angle defining an angle formed between the ninth and tenth edge portions, the ninth edge portion being connected to one of the seventh and eighth edge portions, the tenth edge portion being removably connected to the respective one of the seventh and eighth edges.

12. The foldable structure of claim 10, wherein the first and second rectangles are equally sized.

13. The foldable structure of claim 12, wherein the first panel has an eleventh edge portion that defines a leg of the first rectangle that is opposite to the first edge portion, and wherein the second panel has a twelfth edge portion that defines a leg of the second rectangle that is opposite to the third edge portion.

14. The foldable structure of claim 13, further comprising a net extending between and connected to the second, eleventh, seventh, eighth, twelfth, and fourth edge portions.

15. The foldable structure of claim 13, wherein the foldable structure comprises a foldable tent, and wherein the first panel further comprises a first flexible, fabric cover that covers an internal area of the first flexible, continuous member, and wherein the second panel further comprises a second flexible, fabric cover that covers an internal area of the second flexible, continuous member.

16. The foldable structure of claim 15, wherein the eleventh and twelfth edge portions are adapted to lay on a ground when the tent is unfolded, and wherein the second, fourth, seventh, and eighth edge portions define front and back side edges of the tent when the tent is unfolded, and wherein the first and third edges define a top edge of the tent when the tent is unfolded.

17. The foldable structure of claim 16, further comprising a flexible fabric floor extending between the eleventh and twelfth edge portions.

18. The foldable structure of claim 17, further comprising a flexible fabric wall that connects along its perimeter to the second and fourth edge portions and an edge portion of the floor.

19. The foldable structure of claim 16, further comprising first and second door flaps connected to the seventh and eighth edge portions, respectively.

20. The foldable structure of claim 1, wherein the second panel comprises a base panel that is adapted to lay on a ground when the foldable structure is in the unfolded position, and wherein the first panel comprises an upright panel that is adapted to extend upwardly relative to the base panel when the foldable structure is in the unfolded position.

21. The foldable structure of claim 20, wherein the angle is between 80 and 100 degrees.

22. The foldable structure of claim 21, wherein the first panel further comprises a first fabric cover that at least partially covers an internal area of the first flexible, continuous member, and wherein, when the foldable structure is in the unfolded position, the first cover defines an opening for receiving an object.

23. The foldable structure of claim 22, further comprising a net connected between at least a portion of the perimeters of the first and second panels, the net being adapted to capture the object received through the opening in the first cover.

24. The foldable structure of claim 3, wherein the first and second panels each have substantially linear base edge portions, the base edge portions being adapted to lay on a ground to support the foldable structure when in the unfolded position.

25. The foldable structure of claim 24, wherein the base edge portions of the first and second panels are disposed on opposite sides of the first and second panels, respectively, from the first and third edges, respectively.

26. The foldable structure of claim 25, wherein the first panel further comprises a first fabric cover that at least partially covers an internal area of the first flexible, continuous member, and wherein the first cover has an opening formed in an upper portion thereof for receiving an object.

27. The foldable structure of claim 26, wherein the first cover has a ball return hole formed in a lower portion thereof, and wherein the foldable structure further comprises a ball return passageway operatively connecting the opening to the ball return hole, the ball return passageway being constructed and arranged such that a ball that is received through the opening flows through the ball return passageway and hole and is projected away from the foldable structure.

28. The foldable structure of claim 27, further comprising a backboard and hoop supported between the first and second panels within the passageway.

29. A foldable structure having folded and unfolded positions, the foldable structure comprising:

an upright panel comprising a first foldable, flexible, continuous member and having a first lower edge portion and a second side edge portion, the first lower edge portion being adapted to lay on a ground when the foldable structure is unfolded; and a chain of at least two sequentially-pivotally-connected support panels, each support panel comprising a foldable, flexible, continuous member, a first support panel in the chain having a third edge portion that pivotally connects to the second edge portion, a last support panel in the chain having an additional portion that removably connects to the first edge portion, wherein lengths of the perimeters of the at least two support panels are each less than ½ of a length of a perimeter of the upright panel.

30. The foldable structure of claim 29, wherein the chain of at least two sequentially-pivotally-connected support panels comprises first, second, and last support panels, and wherein the first support panel in the chain has a fourth edge portion; and wherein a second support panel in the chain has fifth and sixth edge portions, the fifth edge portion being pivotally connected to the fourth edge portion; and wherein the last support panel in the chain has a seventh edge portion that is pivotally connected to the sixth edge portion.

31. The foldable structure of claim 30, wherein the second through seventh edge portions are parallel to each other when the foldable structure is unfolded.

32. The foldable structure of claim 29, wherein the foldable structure comprises a goal, and wherein the upright panel has an opening therein that is adapted to receive an object therethrough.

33. A foldable structure having folded and unfolded positions, the foldable structure comprising:

a first panel comprising a first foldable, flexible, continuous member and a first fabric cover that at least partially covers an internal area of the first flexible, continuous member;

a second panel pivotally connected to the first panel, the second panel comprising a second foldable, flexible, continuous member and a second fabric cover that at least partially covers an internal area of the second flexible, continuous member; and a third support panel pivotally connected to one of the first and second panels and removably connected to the other of the first and second panels such that, when the foldable structure is in the unfolded position, the third support panel connects to the other of the first and second panels and the third support panel holds the first and second panels at a predetermined angle relative to each other, wherein a length of a perimeter of the third support panel is less than ½ of a length of a perimeter of either of the first or second panels.

34. The foldable structure of claim 33, wherein the third support panel comprises a third flexible continuous member and a third fabric cover that at least partially covers an internal area of the third flexible, continuous member.

* * * * *